United States Patent [19]

Simon

[11] Patent Number: 4,944,700

[45] Date of Patent: Jul. 31, 1990

[54] ELECTRICAL CONNECTING CLAMP

[76] Inventor: Hans Simon, Bruchausener Strasse, 5463 Unkel/Rhein, Fed. Rep. of Germany

[21] Appl. No.: 321,015

[22] Filed: Mar. 9, 1989

[30] Foreign Application Priority Data

Mar. 11, 1988 [DE] Fed. Rep. of Germany ..... 3808197

[51] Int. Cl.[5] ..... H01R 4/34

[52] U.S. Cl. ..... 439/801; 439/856

[58] Field of Search ..... 439/721, 801, 813, 781, 439/782, 791, 723, 724, 92, 100, 856, 857

[56] References Cited

U.S. PATENT DOCUMENTS

| | | | |
|---|---|---|---|
| 3,412,369 | 11/1968 | Fox | 439/857 |
| 3,609,654 | 9/1971 | Wallo | 439/801 |
| 4,519,668 | 5/1985 | Fujita et al. | 439/801 |

FOREIGN PATENT DOCUMENTS

| | | | |
|---|---|---|---|
| 2232556 | 1/1973 | Fed. Rep. of Germany | 439/813 |
| 626243 | 7/1949 | United Kingdom | 439/527 |
| 1189891 | 4/1970 | United Kingdom | 439/801 |

*Primary Examiner*—Gary F. Paumen

[57] ABSTRACT

The invention relates to an electrical connecting clamp for connecting an electric conductor to an electrical device. The clamp has a substantially U-shaped body having a midsection to which conductor can be connected by means of a clamping screw. One arm of the body ends in an insertable blade. A resilient contact element is formed on the other arm for contact with an insertable blade or a pin. Such a resilient contact element can be provided by forming the other arm with an opening and providing bevelled lead-in parts extending in the direction of insertion.

5 Claims, 2 Drawing Sheets

ELECTRICAL CONNECTING CLAMP

BACKGROUND OF THE INVENTION

The invention relates to an electrical connection clamp for connecting an electrical conductor to an electrical device such as an electrical connection box or connecting bar for connecting the conductors of a connecting cable to an electrical device, e.g., an electric oven. The connecting clamp has a substantially U-shaped clamping body, having a midsection to which the conductor is preferably connected by means of a clamping screw, and one arm of which ends in at least one insertable blade.

Such a connecting clamp is described in the unpublished DE- OS 36 43 593.

By means of the clamping screw, the electrical conductor is clamped to a connecting clamp.

A corresponding flat socket may be mounted on an end of a second conductor for receiving the insertable blade, whereby both conductors will be electrically connected to each other.

Such connecting clamps are used in so-called cable connection boxes or cable connection bars, with which an electrical connection cable is joined to an electrical device such as an electric cooker.

The connection box is normally located in an opening in the casing of the electrical device and forms, as such, the intersection between an outer network and the device.

The ends of the cable leading into the device are normally provided with sockets, mounted on the insertable blades, which extend on the under/inner side of the connection box.

By the clamping screw which is accessible after a cap of the connection box has been opened, the individual conductors from the connection cable can be connected by an electrician. In a similar way, connection takes place by means of a connection bar, which is located inside a casing of the device, and is therefore not so easily accessible from the outside.

Conventional connection clamps only have the insertable blades mentioned for flat sockets as "inner" connection parts. Often, however, one or the other end of the conductors leading into the insides of the device are not provided with such a flat socket, but with a insertion element, i.e., a flat insertable blade or a pin. Such an insertion element cannot then automatically be connected to the known connecting clamp, and a special coupling piece is required. This is particularly the case with interference eliminator filters, which are housed inside the device and which have at least one (in practice three) flat insertable blade or pin, which has to be connected with one of three conductors of the connection cables.

For such connection, three connecting wires were previously required, each provided with a flat socket on both of its ends. Apart from the fact assembly is thereby complicated and expensive, the electrical efficiency of the interference filter is thereby reduced.

SUMMARY OF THE INVENTION

An object of the invention is to produce a connecting clamp of the above mentioned type, onto which an insertable blade or pin can be directly attached, e.g., for the further direct connection in particular of an interference elimination filter.

According to an aspect of the invention there is provided an electrical connecting clamp for connecting an electrical conductor to an electrical device such as an electrical connection box or connecting bar for connecting the conductor of a connecting cable to an electrical device, e.g., an electric oven, the connecting clamp having a substantially U-shaped clamping body/-midsection to which the conductor is preferably connected by means of a clamping screw, and one arm of which ends in at least one insertable blade, characterized in that on the other arm at least one resilient contact element is formed, which includes an opening extending in the direction of insertion dividing the arm into two resilient walls.

This enables the second arm of the U-shaped clamping body to be sub-divided by punching out a particular part to leave the two resilient side walls. The springiness of both resilient walls may be improved by forming a widened part at the upper end of the punched out part. Between these two resilient walls, an insertion element, in particular a conventional insertable blade, can be inserted, whereby an electrical contact is produced under resilient contact pressure. Each wall may be provided with a bevelled lead-in portion.

It is very advantageous for this additional or optional resilient contact to be produced by the same technique as the clamp i.e., by punching and bending from sheet material. There is therefore no additional cost during production.

The resilience of the two springy walls to each other and thereby to the insertion element can be improved by forming a recess in the U-shaped arm on both sides above the stamped out part or opening.

An engagement projection may be provided on one resilient wall (and/or on the side of the opening) which engages the conventional engagement hole of an insertable blade. Such an engagement projection improves the electrical contact by raising the contact pressure pointwise.

Preferably one resilient wall has two contact projections and the other resilient wall has a contact and/or engagement projection therebetween, whereby an insertable element or blade is bent during insertion by the contact projections.

The insertable blade inserted between the engagement projections on both sides will resiliently bend, whereby the contact will be improved as can be easily seen. In addition, an insertable blade which is far thinner than the width or breadth of the stamped out part can be inserted into the opening left by the stamped out part and be resiliently contacted.

On each of the two resilient walls a springy bracket may be formed by stamping. The brackets may further be formed by lateral bending of sections forming the brackets and the sections may be arched towards each other at free ends thereof.

A second solution to the problem mentioned above is proposed and according to another aspect of the invention there is provided an electric connecting clamp to connect an electrical conductor to an electrical device, such as an electrical connection box or connecting bar for connecting the conductor of a connecting cable to an electrical device e.g., to an electric oven, the connecting clamp having a substantially U-shaped clamping body having a midsection to which the conductor can be connected, preferably be means of a clamping screw, and one arm of which ends in at least one insertable blade, characterized in that the other arm of the clamping body is bent to roughly half its length on the side and is bent upwards at a distance corresponding to the thickness of an insertion element to be inserted, whereby a laterally bent face having a perforation therein to engage and guide the insertion element and an upwardly bent end is formed as a counter pressure spring for engaging the insertion element.

Metallic device casings and/or devices must be grounded as is known, i.e., the metallic casing and/or the metallic device must be connected by electrical conduction to the neutral wire/ground wire of the electrical connecting cable.

This was conventionally achieved by means of additional connecting elements. According to the invention, however, with one and the same connecting clamp all possible, electrical connections can be performed. Accordingly, a connecting flag/ connecting flange may also be formed on the connecting clamp for grounding, in such a way that this grounding connector automatically reaches the metallic casing as a support during assembly.

A safety bracket for the clamping screw may be formed on the midsection by punching it out and bending it upwards. The head of the clamping screw may laterally engage this safety bracket i.e., its stamped out part, so that it can no longer be loosened by mistake during assembly. Although the clamping screw of this safety bracket is initially in the way during insertion, an upper cross piece of the safety bracket may be bent at a slant to the side, in order to make assembly easier, to form a bevelled lead-in section during insertion of the clamping screw. The screw head can be laterally supported when being screwed into place on this bevelled lead-in section, whereby the screwing down process is further facilitated.

Finally, it should still be mentioned that instead of the clamping screw, another connecting part can be formed to connect a conductor of the connecting cable, for example a clamping contact element according to DE-AS 23 42 408 or DE-OS 36 04 617, which is particularly referred to here.

BRIEF DESCRIPTION OF THE DRAWINGS

Three embodiments of the invention are now described by way of example with reference to FIGS. 1, 1*a*, 2 and 3 in which.

DESCRIPTION OF PREFERRED EMBODIMENTS OF THE INVENTION

Figure 1:
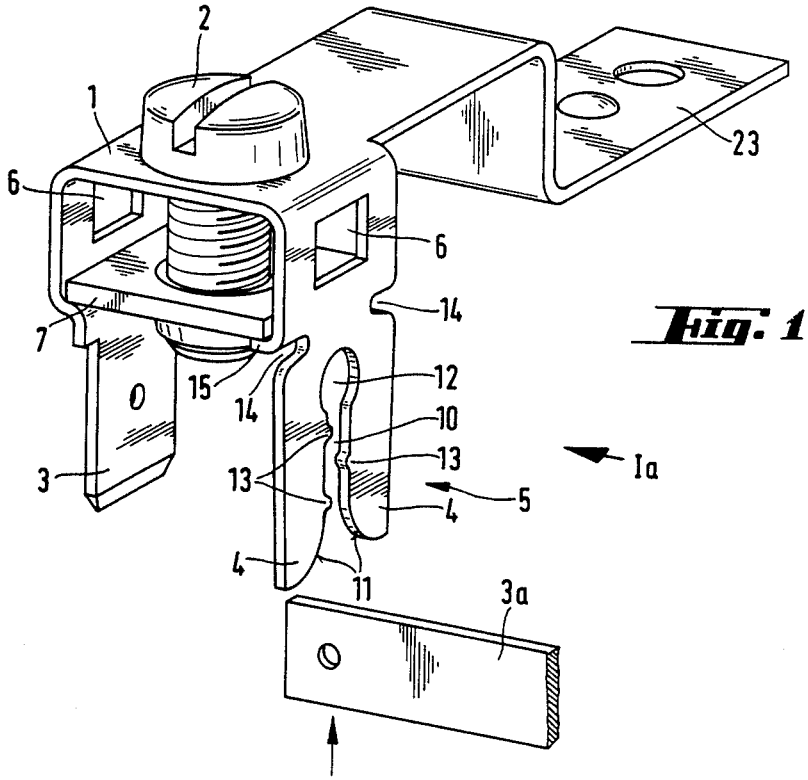
FIG. 1 is a perspective view of one embodiment of the electrical connecting clamp of my invention.

All three embodiment examples are produced by stamping and/or cutting and bending from sheet material. Consequently all parts and functions are formed in one piece. In all three embodiments, a hole in a mid section 1 is provided for mounting and/or screwing in a clamping screw 2. The left arm, as shown in the drawing, ends in one (and/or two) flat insertable blades 3, whereas a resilient one piece contact element 5 is formed by the other arm which has two contact side walls 4. In addition, in all three embodiments a square perforation 6 is formed in the upper region of the two arms which is used as a locating device for a plastic casing (not shown).

According to FIG. 1, a clamping plate 7 is formed with a screw threaded hole in which the clamping screw 2 can be screwed, whereby a conductor 9 (FIG. 3) can be clamped between the clamping plate 7 and the midsection 1. According to FIGS. 1 and 2, a longitudinal opening 10 is stamped in the right arm, which has bevelled lead-in sections 11 below and a widened part 12 above. Side edges of opening are provided with contact projections 13. The left side edge has two contact projections 13 and the right side edge has one contact projection 13 arranged midway therebetween. One contact (or engagement) projection engages the hole H of an insertable blade 3*a* to be mounted. The whole opening 10 therefore has the shape of a key hole open at its bottom end and formed by stamping out a correspondingly shaped part.

Figure 1A:
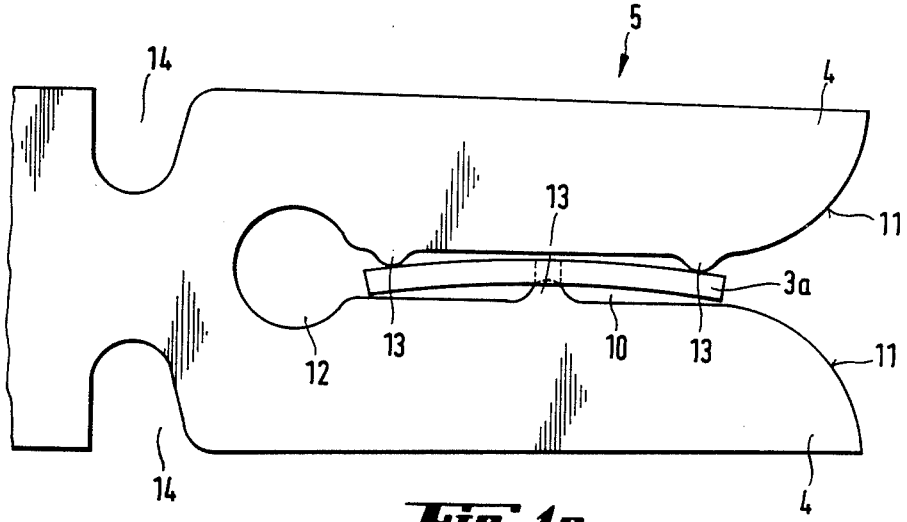
FIG. 1*a* is drawn to a larger scale and is a view of the resilient contact element of FIG. 1 with an insertable blade therein.

The interposed insertable blade 3*a* is flexibly bent between the two contact projections 13 on the one side and the central contact projection on the other (see FIG. 1*a*). The three contact projections 13 therefore fit closely to the insertable blade like three resilient contact points, preferably during interlocking by engaging the middle contact projection 13. By doing so, a relatively very high contact pressure is achieved and a lower transfer resistance is obtained. This is improved still more in that the contact projections 13 slide and/or scrape over the surface of the blade 3*a* when the plug is being inserted, whereby clean contact points are produced at any one time.

Above the opening 10, lateral recesses 14 are formed, whereby the elasticity of the two resilient side walls 4 of the resilient contact element 5 is increased and/or adjusted to the desired amount. Flanges 15 created by formation of the recesses 14 are bent inward and are used as a support for the clamping plate 7 (for the support of which a shoulder 15*a* is bent on the left side). A grounding bracket 23 is shown formed in one piece with the clamp.

Figure 2:
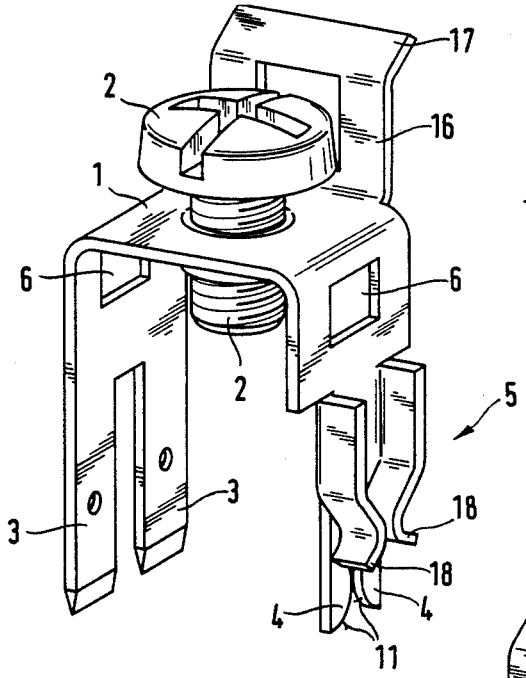
FIG. 2 is a perspective view of a second embodiment of the electrical connecting clamp of my invention.

According to FIG. 2, a screw threaded hole is formed for the clamping screw 2 in the midsection 1. The conductor can therefore be clamped between the screw head and the upper side of the midsection.

Figure 3:
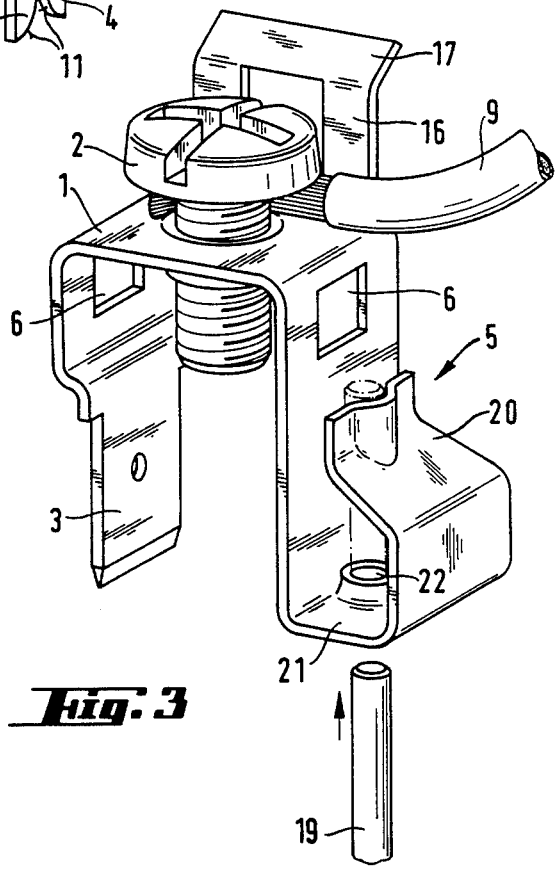
FIG. 3 is a perspective view of a third embodiment of the electrical connecting clamp of my invention.

This applies also to FIG. 3.

A characteristic is that in FIGS. 2 and 3 a safety bracket 16 is produced by rectangularly stamping out and bending upwards a flange originally extending on the level of the upper part or midsection, which not only laterally secures the conductor from one side, but also engages the screw and protects the screw head from unintentional unscrewing. When using the clamping screw 2, this safety bracket would be in the way. Its upper crosspiece 17 is therefore bent at an angle to the side, whereby a bevelled or inclined lead-in portion is formed when inserting the clamping screw—which also makes screwing in easier.

The resilient contact element according to FIG. 2 is otherwise formed substantially as in FIG. 1. In addition, however, two lateral springy brackets 18 are formed by stamping out portions of the side walls 4 to form laterally bent parallel flanges 18*a* having free lower regions 18*b* bent or arched shut towards each other. In that way the spring bracket 18 increases the contact capacity and increases the contact surface area with the insertion blade 3*a*.

On the left arm in FIG. 2 two insertable blades 3 are formed which are spaced from each other by stamping out a rectangular piece of material.

An opening 10 can also be stamped on to the insertable blade as in FIG. 1 or 2, so that the insertable blade 3 is formed at the same time as the resilient contact elements.

According to FIG. 3, the resilient contact element is designed to engage a pin 19. To do this, the right arm is bent roughly to the middle of its height to the side to form a flange 20 and then bent inwardly to a distance from the arm corresponding to the thickness of the pin. The upwardly bent flange 20 is formed as a pressure spring, which resiliently contacts and envelopes the inserted pin 19. The lower face 21 is perforated at 22 to engage and lead the pin.

This latter resilient contact can also be produced by stamping and bending i.e., with the same production apparatus as that used to form the connecting clamp.

Instead of a round hole 22, a rectangular hole could be stamped in the lower face according to FIG. 3, to engage a conventional flat insertable blade.

I claim:

1. Electrical connecting clamp, for connecting an electrical conductor to an electrical device such as an electrical connection box or connecting bar for connecting the conductor of a connecting cable to an electrical device, e.g. an electric oven, the connecting clamp having a substantially U-shaped clamping body comprising two parallel arms and a midsection extending therebetween which the conductor is connected by means of a clamping screw on and through said midsection, one said arm of said clamping body ending in at least one insertable blade, characterized in that on the other said arm at least one resilient contact element is formed which differs from said insertable blade, said one resilient contact element including an opening extending in a direction of insertion of an insertable blade, said opening dividing said other arm into two resilient walls each provided with a bevelled lead-in portion, and the opening having a widened part at its end opposite to said lead-in portion to improve resilience.

2. Connecting clamp according to claim 1, characterized in that a lateral recess is stamped out above the opening to improve its resilient properties.

3. Connecting clamp according to claim 1 characterized in that the opening has at least one contact projection.

4. Connecting clamp according to claim 3, characterized in that one said resilient wall has two contact projections and the other resilient wall has a contact and/or engagement projection therebetween, between which projections an insertable element is bent during insertion.

5. Connecting clamp according to claim 1 characterized by a grounding bracket formed in one piece with the clamp.

* * * * *